United States Patent [19]

Balz et al.

[11] Patent Number: 4,480,411

[45] Date of Patent: Nov. 6, 1984

[54] FINISHING CHAMBER WITH READILY-REMOVABLE LINING AND MEANS FOR ASSISTING WITH SAID REMOVAL, AND FINISHING MACHINE EMBODYING THE SAME

[75] Inventors: Gunther W. Balz; Henry L. Upjohn, both of Kalamazoo, Mich.

[73] Assignee: Roto-Finish Company, Inc., Kalamazoo, Mich.

[21] Appl. No.: 324,129

[22] Filed: Nov. 23, 1981

[51] Int. Cl.[3] ..... B24B 31/06

[52] U.S. Cl. ..... 51/163.1; 220/410; 220/453; 156/155

[58] Field of Search ..... 51/163.1, 163.2, 7, 51/277; 220/408, 410, 453; 156/155; 206/524.3

[56] References Cited

U.S. PATENT DOCUMENTS

| | | | |
|---|---|---|---|
| 2,582,087 | 1/1952 | Turner | 51/277 |
| 3,118,253 | 1/1964 | Setzler | 51/163.1 |
| 3,669,503 | 6/1972 | Zimmermann | 51/163.1 |
| 3,808,073 | 4/1974 | Navarre | 156/155 |
| 3,810,585 | 5/1974 | Strom | 51/163.2 |
| 4,001,979 | 1/1977 | Elkins | 51/163.2 |
| 4,307,544 | 12/1981 | Balz | 51/163.2 |

*Primary Examiner*—Harold D. Whitehead

*Attorney, Agent, or Firm*—Gordon W. Hueschen

[57] ABSTRACT

A method of providing a chamber having an interior elastomeric lining suitable for use as the finishing chamber of a finishing machine or the like comprising the step of providing the inner surface of said chamber with a layer of thermally-activatable release agent and adhering the elastomeric lining to said layer of thermally-activatable release agent, the temperature at which said thermally-activatable release agent is activatable being a temperature below that at which substantial deterioration of said elastomeric lining occurs, especially wherein said thermally-activatable release agent is applied to the inner surface of said chamber in activated state and wherein said thermally-activatable release agent is allowed to solidify before adhering said elastomeric lining thereto, particularly wherein said elastomeric lining is formed in place in contact with said solidified thermally-activatable release agent, and especially wherein said elastomeric lining comprises a polyurethane; a method of lining a chamber in such manner; such a chamber having an interior elastomeric lining suitable for use as the finishing chamber of a finishing machine or the like; a method of replacing the interior elastomeric lining of such chamber; and a method of repairing the lining of such chamber, are disclosed.

9 Claims, 7 Drawing Figures

Fig. 1.
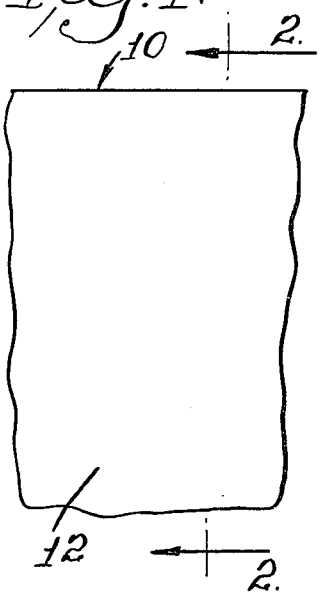
Fig. 2.
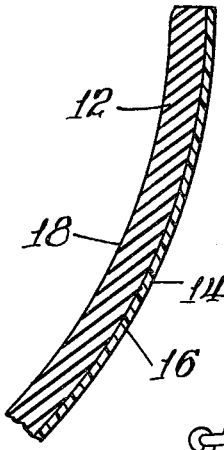
Fig. 3.
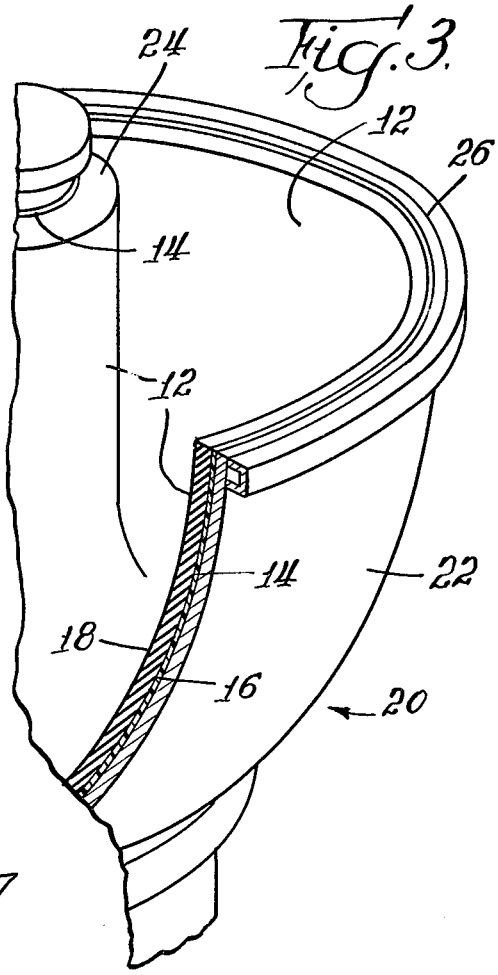
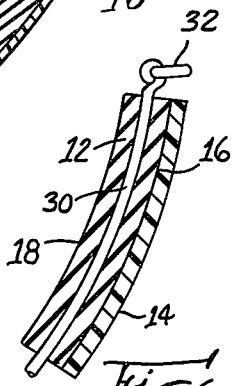
Fig. 7
Fig. 4.
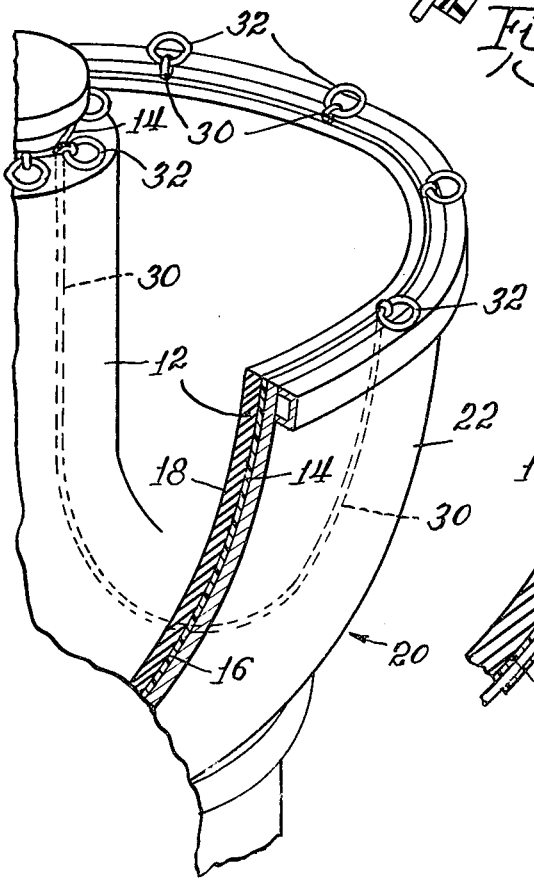
Fig. 5
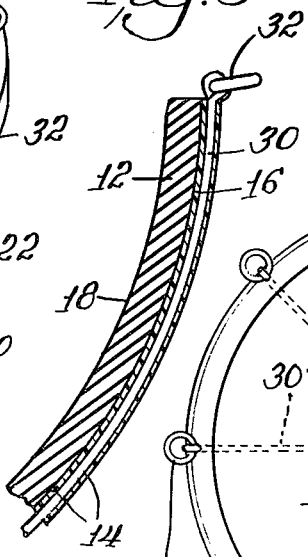
Fig. 6
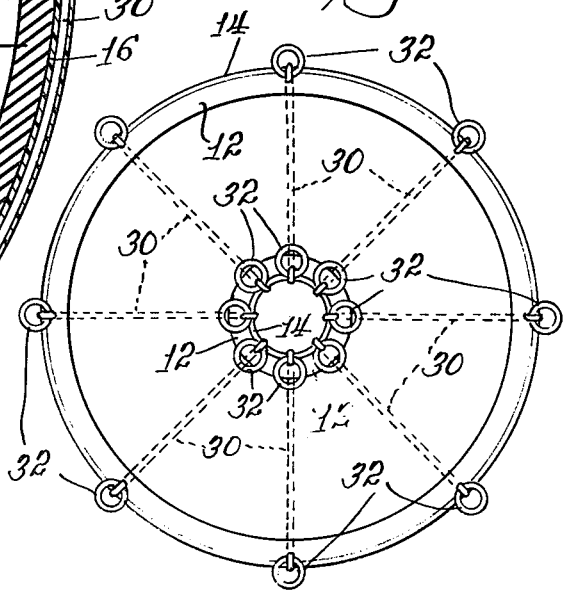

FINISHING CHAMBER WITH READILY-REMOVABLE LINING AND MEANS FOR ASSISTING WITH SAID REMOVAL, AND FINISHING MACHINE EMBODYING THE SAME

BACKGROUND OF THE INVENTION

1. Field of the Invention

The lining of chambers, adapted to comprise the finishing chamber of a finishing machine or the like, the removal, replacement, or repair of such linings, finishing chambers lined therewith, and finishing machines embodying such lined finishing chambers, constitutes the field of this invention.

2. Prior Art

The art is replete with so-called finishing machines of various types, especially vibratory of gyratory types, with or without additional rotative action, or with rotative and/or centrifugal action alone, and of course tumbling barrels are a type of finishing machine which has been known for years. As the art has progressed, the finishing chambers employed have been lined with an elastomeric material of either natural or synthetic nature for prevention of damage to parts or workpieces being finished, due to impingement thereof upon the inner surface of the finishing chamber during the process of finishing therein, and for prevention of excessive wear of the interior surface of the chamber itself. Such finishing has generally been conducted in the finishing chamber of such finishing machines employing a suitable loose abrasive media and parts or workpieces to be finished, usually together with a liquid such as water, and frequently together with agents such as detergents, brightening agents, or lubricating agents of a soapy nature, generally referred to as "compounds". In the finishing chambers of such devices, the parts or workpieces to be finished are subjected to relative movement with respect to the loose finishing media, which may be anything from rock fragments to ceramic "chips" to steel burnishing balls, and the vibratory and/or rotative action imparted to the finishing chamber when in place in such finishing machines produces such relative motion. In vibrational or gyrational apparatus, such relative motion is considered to be both of a micro and a macro nature, inasmuch as the parts to be finished and the loose media move back and forth with respect to each other in a relatively localized area to an extremely localized extent in addition to moving with a generally rolling motion. In both tub-type and curvilinear finishing machines, generally having an arcuate bottom, the entire mass of loose finishing media and parts or workpieces generally moves with a rolling motion, going down at the one side (inside) of the finishing chamber and coming up at the other side (outside) of the finishing chamber, such motion generally being referred to as the "roll". In addition, in curvilinear finishing machines, e.g., the gyratory type of a machine having a curvilinear finishing chamber, usually an annular bowl having a U-shaped cross-section, with or without a step in the bottom, an additional component known as "feed" or "precession" is also introduced. According to the skill of the art, this is generally controlled by the relative settings of eccentric weights carried by a shaft or located on opposite ends of the shaft of an eccentric motor. Sometimes, in linear tub-type vibratory finishing machines, such precession is also provided by employing a slope in the bottom of the finishing chamber.

As the art has progressed, the elastomeric finishing chamber linings have become more and more sophisticated as might be expected. Moreover, as the elastomeric finishing chamber linings have become more sophisticated, they have also become more expensive. Therefore, it is sometimes economically desirable to patch them when localized areas show excessive wear. Further, due to the constantly increasing cost of finishing machines, including finishing chambers, it is not economically feasible to dispose of an entire finishing chamber simply because the lining is in need of repair or replacement. Thus, it has become standard practice in the art to remove finishing chamber linings when obsolete or otherwise in need of replacement and to replace them with new linings of the same or different type of elastomer, as required or desired, when repair is no longer feasible. However, adherence of the elastomeric lining to the usual metal, e.g., mild or stainless steel, finishing chamber is tenacious, and this adhesion is not readily broken. Consequently, removal of finishing chamber linings has been fraught with great difficulty. Efforts have been made to solve the problem conveniently by burning, heating in ovens, or exposure to solvents, including heated solvents, over extended periods. However, such practices have not been accepted by regulatory authorities and present numerous unacceptable health hazards as well as unacceptable in-plant fire, explosion, and safety hazards in general. Moreover, to the extent that such practices have been successful, they have often been self-defeating inasmuch as the temperature necessary to attain the desired deterioration or disintegration of the finishing chamber lining, for facilitating its removal from the chamber proper, have frequently resulted in weakening the chamber itself or warping of the same along with other structural failures, including in some cases even melting and/or puncturing thereof, with the ultimate result that the entire finishing chamber requires replacement rather than only the lining thereof. An additional disadvantage of prior art procedure is that, whatever the procedure followed, it has been difficult if not impossible to remove the finishing chamber lining in an integral or unitary form, with the result that the piecewise or portionwise removal of the lining, and the necessary scratching and scraping essential to attain the same, is excessively time consuming, laborious, and uneconomic, especially since it generally requires a great deal of hand labor.

In view of such obvious shortcomings and disadvantages, it is apparent that a solution to this now longstanding and economically important problem is both highly desirable and overdue. Such a solution is provided according to the present invention. It goes without saying that such solution as is provided according to the present invention is applicable not only to finishing chambers but also to similar or related chambers such as are employed for mixing or sieving operations in existing mixing or sieving devices as well as similar chambers of related machines in which an interior elastomeric lining is employed.

OBJECTS OF THE INVENTION

It is an object of the present invention to provide an elastomeric lining for a chamber adapted to be the finishing chamber of a finishing machine or the like which alleviates the foregoing problems and shortcomings, and whereby removal, replacement, or repair of the lining is greatly facilitated, as well as such chambers lined with said novel lining and machines embodying such lined chambers. A further object is to provide a finishing chamber lined with such an improved lining and finishing machines embodying the same: A still further object is to provide a chamber lined with the usual type of elastomer but wherein a layer of thermally-activatable release agent is interposed between the inner surface of the chamber and the interior elastomeric lining thereof. Yet another object is to provide such a lining wherein the layer of thermally-activatable release agent is thermally activatable or reactivatable at a temperature below that temperature at which substantial deterioration of the inner elastomeric lining takes place. Yet a further object is to provide such a lined chamber wherefrom, when desired, the interior elastomeric lining may be removed as an integral or unitary segment, or essentially so, as opposed to piecemeal and/or in small segments. Still further objects will be apparent to one skilled in the art and still additional objects of the invention will become apparent hereinafter.

SUMMARY OF THE INVENTION

The invention, in summary, comprises inter alia, a method of providing a chamber having an interior elastomeric lining suitable for use as the finishing chamber of a finishing machine or the like comprising the step of providing the inner surface of said chamber with a layer of thermally-activatable release agent and adhering the elastomeric lining to said layer of thermally-activatable release agent, the temperature at which said thermally-activatable release agent is activatable being a temperature below that at which substantial deterioration of said elastomeric lining occurs, such method wherein said thermally-activatable release agent is applied to the inner surface of said chamber in activated state, such method wherein said thermally-activatable release agent is allowed to solidify before adhering said elastomeric lining thereto, such method wherein said elastomeric lining is formed in place in contact with said solidified thermally-activatable release agent, such method wherein said elastomeric lining comprises a polyurethane, such method wherein said elastomeric lining comprises a formed-in-place polyurethane, such method wherein said polyurethane is formed by pouring in place in contact with said solidified thermally-activatable release agent in fluid or semi-fluid condition and allowed to cure in place, such method wherein said polyurethane is a multi-part system, such method wherein said thermally-activatable release agent is thermally activatable at a temperature below about 250° F., preferably at a temperature at or below about 100° C., usually at a temperature below about 200° F., such method wherein said thermally-activatable release agent is a hot-melt adhesive, such method wherein the elastomeric lining is formed from a material selected from the group including natural and synthetic elastomers, such method wherein said elastomeric lining comprises polyurethane, such method including the step of incorporating lifting means within said chamber and associated with said lining for attachment of pulling means to assist with subsequent removal of said lining from said chamber; and a method of lining a chamber suitable for use as the finishing chamber of a finishing machine or the like with an elastomeric lining comprising the step of coating the inner surface of said chamber with a layer of thermally-activatable release agent while in activated state, allowing it to solidify, and adhering the elastomeric lining to said solidified layer of thermally-activatable release agent by forming said elastomeric lining in place in contact with said solidified thermally-activatable release agent, the temperature at which said thermally-activatable release agent is activatable being a temperature below that at which substantial deterioration of said elastomeric lining occurs, such method wherein said elastomeric lining comprises a polyurethane, such method wherein said elastomeric lining comprises a poured-in-place polyurethane, such method wherein said polyurethane is formed by pouring in place in contact with said solidified thermally-activatable release agent in fluid or semi-fluid condition and allowed to cure in place, such method wherein said polyurethane is a multi-part system, such method wherein said thermally-activatable release agent is applied to the inner surface of said chamber in fluid or liquid form, such method wherein said thermally-activatable release agent is a hot-melt adhesive, such method including the step of incorporating lifting means within said chamber and associated with said lining for attachment of pulling means to assist with subsequent removal of said lining from said chamber; and a chamber having an interior elastomeric lining suitable for use as the finishing chamber of a finishing machine or the like, comprising the said chamber, an inner elastomeric lining therefor, and interposed between the inner surface of said chamber and said lining a layer of thermally-activatable release agent in solid form, said thermally-activatable release agent being thermally activatable at a temperature below that temperature at which substantial deterioration of the said elastomeric lining occurs, such chamber wherein the elastomeric lining is formed from a material selected from the group including natural and synthetic elastomers, such chamber wherein said elastomeric lining comprises a polyurethane, such chamber wherein the lining is a formed-in-place polyurethane lining, such chamber wherein said thermally-activatable release agent is thermally activatable at a temperature below about 250° F., preferably at a temperature below about 200° F., usually at a temperature at or below about 100° C., such chamber wherein said thermally-activatable release agent is a hot-melt adhesive, such chamber comprising also lifting means associated with said interior lining for attachment of pulling means to assist with removal of said interior elastomeric lining from said chamber; and a finishing machine embodying any such finishing chamber; and a method of replacing the interior elastomeric lining of a chamber suitable for use as the finishing chamber of a finishing machine or the like which comprises, interposed between said chamber and said interior elastomeric lining, a solid layer of thermally-activatable release agent, said thermally-activatable release agent being thermally activatable at a temperature below that temperature at which substantial deterioration of said elastomeric lining occurs, comprising the steps of activating said thermally-activatable release agent by bringing it to a temperature at which it is thermally activated, but at which substantial deterioration of said lining does not occur, and removing said elastomeric lining from said chamber while said thermally-activatable release agent is in active releasing condition, such method wherein said elastomeric lining comprises a polyurethane, such method wherein the elastomeric lining is formed-in-place polyurethane lining, such method wherein said elastomeric lining is removed from said chamber as a substantially integral unit, such method wherein lifting means are associated with said interior lining for attachment of pulling means to assist with removal of said interior elastomeric lining from said chamber as a substantially integral unit, such method wherein said release agent is activated by the general application of heat, and a method of repairing a chamber having an interior elastomeric lining suitable for use as the finishing chamber of a finishing machine or the like, wherein said chamber comprises a solid layer of thermally-activatable release agent between said chamber and said interior elastomeric lining, wherein said thermally-activatable release agent is thermally activatable at a temperature below that at which substantial deterioration of said elastomeric lining occurs, comprising the steps of defining a limited area of said elastomeric lining in need of replacement, activating said thermally-activatable release agent in that area by bringing it to a temperature at which it is activated but below that temperature at which substantial deterioration of said elastomeric lining occurs, removing the said limited area of said elastomeric lining in need of replacement and replacing said removed area by an area of new elastomeric lining of essentially the same size, such method wherein said new elastomeric lining is applied while said thermally-activatable release agent is in activated condition, such method wherein said thermally-activatable release agent is allowed to solidify and said new area of said elastomeric lining is formed in place thereover, such method wherein said elastomeric lining comprises a polyurethane, such method wherein the elastomeric lining is a formed-in-place polyurethane lining, and such method wherein said release agent is activated by local application of heat.

DESCRIPTION OF THE DRAWINGS

A more complete understanding of the invention may be had by reference to the following detailed description when taken in conjunction with the accompanying drawings, wherein:

FIG. 1 is an enlarged partial face view of a lining in accord with the present invention.

FIG. 2 is a cross-sectional view of the lining of FIG. 1 taken along the line 2—2 thereof.

FIG. 3 is a partial perspective view of a vibratory finishing machine incorporating a chamber lined with a lining in accord with the present invention.

FIG. 4 is a partial perspective view of a vibratory finishing machine incorporating another embodiment of a chamber lined with a lining in accord with the present invention, and including lifting means for assisting with lifting the liner from within the chamber for removal and/or replacement thereof.

FIG. 5 is a cross-sectional view of the lining of FIG. 4 showing lifting means associated therewith.

FIG. 6 is a top plan view of the lining and associated lifting means as incorporated in the chamber of the vibratory finishing machine of FIG. 4.

FIG. 7 shows the cross-section of an alternative embodiment, similar to the cross-section of FIG. 5, but wherein the lifting means is disposed in the interior liming of the chamber rather than in the thermoplastic adhesive layer.

DETAILED DESCRIPTION

Referring now to the drawings, and particularly to FIG. 1 thereof, the chamber lining of the invention is shown in an enlarged partial face view at 10. In this view, the thermally-activatable release agent is not visible.

FIG. 2 shows an enlarged cross-section of a chamber lining or liner 12 according to the invention, being a cross-section of the chamber lining of FIG. 1 taken along the line 2—2 thereof. In FIG. 2 are indicated the non-working surface 16 and the working surface 18 of the chamber elastomeric lining or liner. By the term "working surface", as used herein, is intended the exposed surface of the internal elastomeric lining or liner when in place in a finishing chamber or the like, and which is subjected to abrasion or friction or at least to the working action of the contents of the chamber when in operation. Conversely, the term "non-working surface", as applied to the inner elastomeric lining, is to be understood as meaning that surface which is opposite to the working surface of the elastomeric lining or liner and which is not subjected to the abrasion and/or friction and/or working effects of the contents of the chamber when the finishing machine in which such a chamber is mounted is in operation. In FIG. 2 is also shown the layer of thermally-activatable release agent 14, which is bonded to the non-working surface 16 of the inner elastomeric lining 12 on the one side and to the interior surface of the finishing chamber itself on the other.

In FIG. 3 is shown the complete lining in place in the finishing chamber of a vibratory finishing machine. This vibratory finishing machine is shown generally at 20 and is of the type which includes a toroidal bowl or tub 22. The toroidal bowl 22 may also be considered as comprising an annular hopper having a generally U-shaped cross-section. The bowl or hopper 22 has an interior upper circular rim 24 and an outer upper circular rim 26, each extending around the entire circumference of the bowl 22. The bowl 22 may or may not have a step in the bottom thereof, depending upon the use for which the machine is intended and the method of separation of the contents to be employed in conjunction with the process conducted therein. The bowl or tub 22 of finishing machine 20 is typically formed of a suitable metal, such as steel, and is generally mounted on suitable springs or other resilient material (not shown) so as to permit vibration of the hopper or tub 22 and the contents thereof. Depending upon the type and location of the drive means employed in conjunction therewith, and its orientation with respect to bowl 22, the finishing chamber, that is, the bowl or hopper 22 of the finishing machine 20, will either vibrate or gyrate according to knowledge and procedure already standard in the art. Interior elastomeric lining 12 extends over the entire interior surface of the finishing chamber, and its working surface is shown at 18, whereas its non-working surface is shown at 16. Between non-working surface 16 of interior elastomeric liner 12 and the inner surface of outer bowl or tub 22 is interposed the essential layer of thermally-activatable release agent 14, bonding non-working surface 16 of the interior elastomeric lining 12 to the inner surface of the chamber, i.e., bowl, tub, or hopper 22.

FIG. 4 shows another vibratory finishing machine embodying a lined finishing chamber according to the invention, but in this case embodying also lifting means for assisting with lifting the interior elastomeric lining 12 from within chamber 22 in the form of cables or wires 30 disposed between the outer wall of the finishing chamber 22 and lining 12. These means are, as shown, associated with the lining in the form of cables or wires 30, terminating at each of their ends in rings 32, which may be grasped by external means such as a crane or a chain hoist for purposes of assisting with removal of internal elastomeric lining 12 from within chamber 22 after thermally-activatable release agent 14 has been activated so that lining 12 no longer adheres to the inside of chamber 22. A preferred procedure is to place the thermally-activatable release agent in contact with the inner surface of the chamber, in activated state, and then dispose means 30 adjacent the interior surface of chamber 22 and allow the thermally-activatable release agent to set, thereby retaining means 30 in place. Additional thermally-activatable release agent may then be disposed over the internal surface areas of chamber 22 and over means 30, and allowed to set, whereafter the elastomeric lining 12 is poured thereover in usual manner.

This provides a cross-section of the lining at the lifting means such as shown in FIG. 5, and a top plan of the chamber lining as shown in FIG. 6 with the lifting means 30 being shown in shadow lines therein. Although said lifting means, as shown, is in the form of cables or wires 30 attached to rings 32, it is apparent that it may take many forms, such as cavities in the lining itself, strapping, wire, cable, a wire network or the like. When not formed directly in the cast elastomer, such means is preferably flexible, so as to permit the ends of the lifting means disposed at the interior upper circular rim 24 and outer upper circular rim 26 to be drawn toward each other, as by means of a cable clamp or a hook attached to a chain hoist or crane or the like, for purposes of lifting the loosened interior elastomeric lining 12 bodily, and preferably as an essentially integral unit, out of the interior of chamber 22.

It is to be clearly understood that the chamber lining of the present invention is not in any way to be limited to liners for vibratory or gyratory finishing machines having the particular construction illustrated in the drawings, but that it may be employed in conjunction with the finishing chamber of any standard industrial type machine whether vibratory or gyratory or other type, whether a tub-type or curvilinear, e.g., annular with an arcuate bottom, whether solely or additionally mounted for rotative or spinning movement, whether involving means for automatic separation or not, and whether including partitions or dividers for maintaining parts or workpieces separate from each other during a finishing process, or otherwise, all as is well-known in the art. The only limitation to be imposed upon the chamber and chamber lining of the present invention is that it is suitable for use in an industrial machine, particularly of a vibratory, gyratory, or rotative nature.

THERMALLY-ACTIVATABLE RELEASE AGENT

An essential aspect of the present invention is the layer of thermally-activatable release agent, which is interposed between the interior surface of the selected chamber, which is adapted to be the finishing chamber of a finishing machine or the like, and the interior elastomeric lining thereof. Essential characteristics of this thermally-activatable release agent are that it be a solid at room temperature, that its adhesive characteristics and viscosity diminish upon the application of heat, that after solidification it is reactivatable by the application of heat, and that it be thermally activatable at a temperature below that temperature at which substantial deterioration of the elastomeric lining, with which the interior of the chamber is lined, occurs. Of course, the release agent must have substantial cold strength, so as to hold the elastomeric lining in place at room temperatures, and preferably sufficient cold strength to prevent such bond from being broken if the chamber should inadvertently or otherwise be exposed to freezing temperatures.

By activatable is meant softenable, and the softening point of the thermally-activatable release agent, or the glass transition temperature thereof, should be below that point at which substantial deterioration of the elastomer employed for the elastomeric lining occurs. This softening point or glass transition temperature is therefore generally below 250° F., preferably below about 200° F., and usually at or below about 100° C. (212° F.), which is the temperature at which deterioration of many elastomeric linings, such as polyurethane linings, occurs after a period of exposure of approximately twenty-four hours.

The thermally-activatable release agent is, according to the present invention, generally applied to the interior surface of the chamber and allowed to harden. It is generally also a hot-melt adhesive. After hardening, however, it is no longer characterized by adhesive properties unless reactivated. It is in the hardened, set, or solidified stage that the elastomeric lining is usually poured or cast into contact therewith according to the present invention. When it is a preformed elastomeric lining, it is applied to the layer of thermally-activatable release agent in its activated or reactivated state, although this is not the preferred mode of operation. When the thermally-activatable release agent has solidified, the poured or cast elastomer, such as a polyurethane elastomeric lining, adheres tenaciously thereto. For removal of the lining as an integral unit or practically intact, the thermally-activatable release agent is reactivated by the application of heat in any one of various ways, as will be further hereinafter described. For patching or replacement of worn areas of the interior elastomeric lining, the thermally-activatable release agent is activated, after defining the worn area by making incisions therein to free it from its surrounding lining, and the worn area removed. Thereafter, the thermally-activated release agent in the then unlined area can be contacted with a preformed patch while in its already reactivated state and allowed to harden, but preferably the thermally-activatable release agent is first allowed to harden and then additional elastomeric lining is cast or poured, into the opening from which the worn material has been removed, and allowed to cure, thereby in most cases presenting a uniform surface in which the patched area is often not discernible.

Innumerable thermally-activatable release agents which fill the requirements of the present invention are available, both commercially and otherwise. Particularly advantageous thermally-activatable release agents are those hot-melt adhesives available from 3M as JET-MELT 3783, 3765, and 3735 (TMs), as well as Ornsteen hot-melt adhesives, especially 4046 and 8096 (TMs). Such 3M products are latex emulsions of ethylene-vinylacetate copolymers, either alone or in admixture or blend with hydrocarbon and/or thermoplastic resins and/or a wood rosin, with minor amounts (up to about 1%) of tackifier and/or antioxidant. An increase in the proportion of ethylene appears to cause an elevation in the glass transition or melt temperature. Of the 3M products mentioned, 3735 has a heat resistance of 115° F. and a ball and ring softening point according to ASTM E-28-67 of 169° F., 3765 has a heat resistance of 130° F. and a softening point of 172° F., and 3783 has a heat resistance of 145° F. and a softening point of 190° F. As stated, these have been found particularly suitable as a thermally-activatable release agent for use according to the invention. However, other hot-melt adhesives in the 3M series, such as 3738, 3740, 3743, 3746, 3758, 3762, and 3764 are also suitable, although 3735, 3765, and especially 3783 are preferred because of their particularly desirable performance characteristics as well as their appropriate softening temperatures. 3M JET-MELT 3783 has an impact resistance in inch pounds at 0° F. of 20, at 72° F. of 84, a tensile (psi) strength of 900, and a percent elongation of 500, and is a preferred thermally-activatable release agent according to the invention. Ornsteen 4046 and 8096 respectively have softening points of 193° and 206° F., an adhesive tensile (psi) strength of 180 and 300, a film elongation of 1400 and 1000 percent, a shear value in the stainless steel test in psi of 208 and 396, and a heat resistance under a 2 psi load of 120° F. and 138° F., and have also been found suitable according to the invention. Other hot-melt adhesives in the Ornsteen line are also suitable. Likewise, hot-melt adhesives 4046 and 8096 from the Hysol Division of the Dexter Corporation are also suitable for use as the thermally-activatable release agent according to the invention, respectively being a rubber/ethylene-vinylacetate resin physical mixture of components in petroleum hydrocarbon and a physical mixture of rubber/ethylene-vinylacetate/resin, in either case having good bonding capacity. Further adhesives which may be employed as the thermally-activatable release agent according to the invention are found on pages 188–206 of the treatise entitled "Adhesive and Sealant Compounds and Their Formulations", Ernest W. Slick, author, published by Noyes-Data Corporation of Parkridge, N.J., 1978. These may be polyamides, to which may be added ethylene/vinylacetate copolymer resin, to increase cohesion and strength; polybutene/resin/butyl rubber; polyterpene/ethylene-vinylacetate; polyvinylbutyral resin; methylmethacrylate resin with chlorinated rubber; ethylene-vinylacetate-polyterpene-resin combinations; ethyl cellulose containing compositions; polybutene-butyl rubber compositions; resin-polyvinylbutyral compositions; polyamide mixtures; resin-rubber compositions, and the like, as set forth in the said publication. When higher temperatures are desired for softening or for the glass transition temperature, a higher proportion of end block groups is usually employed, whereas a higher percentage of mid block groups is usually employed when a lower softening or glass transition temperature is required or desired, so that modifications with these objectives in mind are readily effected, in existing hot-melt adhesives and other thermally-activatable release agents, by one skilled in the art. For a material to be a satisfactory thermally-activatable release agent, it is only necessary that it be solid at room temperature and thermally activatable at a temperature below that at which substantial deterioration of the interior elastomeric lining occurs, and that it effect an adequate bond between the interior surface of the chamber and the elastomeric lining.

THE ELASTOMERIC LINING

Any suitable and usual elastomer can be employed in producing the elastomeric chamber lining according to the invention. The term "elastomeric lining" as used herein is to be understood to be a lining formed of any of numerous natural or synthetic elastomers which stretch under tension, have a high tensile strength, retract rapidly, and essentially recover their original dimensions fully. Examples of such suitable elastomers which can be employed in production of the elastomeric chamber lining according to the invention include natural rubber, homopolymers such as polychlorobutadiene, polybutadiene and polyisoprene, copolymers such as styrene-butadiene rubber, butyl rubber, nitrile rubber, ethylene-propylene copolymers, fluorine elastomers, and polyacrylates, polycondensation products such as polyurethanes, neoprene, ABS rubber, PVC rubber, silicone rubber, and polysulfide rubber, and chemical conversions of high polymers such as halogen-substituted rubbers. The elastomeric substrate generally has a Shore A hardness of between fifty (50) and one hundred (100), with a Shore A hardness of about sixty-five (65) to about ninety (90) usually being preferred. When the elastomer is of the polyurethane type, it may be prepared by the prepolymer method or by mixing the ingredients concurrently or simultaneously through several nozzles in a so-called "one-shot" application involving the instantaneous reaction of two or three components. The ADIPRENE (TM) family of urethane elastomers produced by DuPont, and CONATHANE (TM) two-component polyurethane casting systems, produced by Conap, Inc., Olean, N.Y., are particularly suitable for use in accord with the present invention. The CONATHANE TU-79 (TM) system is particularly adaptable to the production of finishing chamber linings inasmuch as it attains a Shore A hardness of 80±5 and has excellent tensile strength and compression characteristics. Moreover, upon admixture of the two parts of the two-part system, the initial mixed viscosity at 25° C. or 77° F. is only 4,000 cps, thus making it pourable into almost any configuration for the production of chamber linings according to the present invention, whether in forms to be subsequently bonded to the release agent interior of the finishing chamber or whether poured directly into the finishing chamber, thereby to become self-bonding to the thermally-activatable release agent on the interior surface thereof upon curing. With a pot-life of 35 to 40 minutes at 25° C. and the ability to cure at room or elevated temperatures, this system has been found highly satisfactory. The cure of one hour at 25° C. plus 16 hours at 80° C., is convenient and, alternatively, the applied elastomer can be cured by allowing to stand for seven (7) days or less at 25° C. If molds are used, mold releases can if desired also be employed to obtain rapid, clean, and convenient release from the mold, as is conventional in the art. The elastomeric linings are preferably bonded to the thermally-activatable release agent inside of the finishing chamber by pouring in place in fluid or semifluid condition and allowing to cure in place, with possible application of heat and use of curing agents if desired, or they may less desirably be preformed and bonded to the thermally-activatable release agent inside of the finishing chamber directly, with or without the application of external heat and/or further adhesive.

When a primer is required or desired on the surface of the interposed thermally-activatable release agent layer, such primer can conveniently be CONAP AD-6 (TM) primer, which is a two-component system consisting of a modified polyvinyl butyral resin employing a phosphoric acid catalyst. This primer is designed specifically for priming metal substrates, and provides an effective means for effecting excellent adhesion, corrosion resistance, water resistance, impact resistance, and flexibility. Such a primer may also be recommended in certain cases as an interior coating of the chamber directly on the metal prior to coating the same with the essential thermally-activatable release agent.

The elastomeric lining may, if desired, contain dispersed therein small amounts of finely divided abrasive, small metal balls, or the like, or may be essentially free of the same.

PRIOR ART PRACTICE

The present method of lining a chamber, adapted for use as the finishing chamber of a finishing machine or the like, is to sandblast the chamber or tub and prime it with a material such as polyurethane primer CONAP AD-6 (TM). Then a polyurethane, such as CONAP TU-79 (TM) is premixed by combining parts A and B and injected into the tub with a mold in place therein for forming the lining to suitable dimensions. After a suitable period, for example 48 hours, the mold is removed. Such operation is not difficult inasmuch as the mold is covered with mold release agent. The solidified urethane lining remains in the chamber and continues to cure.

After a period of use, the lining is not evenly worn, but wear is apparent in certain areas. A considerable amount of the lining remains to be removed at each relining operation. This is done only with difficulty and piecemeal at best and suffers from the inconveniences and disadvantages hereinbefore outlined.

PRACTICE OF THE INVENTION

According to the invention, the metal chamber, adapted to constitute the finishing chamber of a finishing machine or the like, is as usual sandblasted on its inner surface, whereafter the thermally-activatable release agent, e.g., a hot-melt adhesive such as 3M JET-MELT 3765, is fluidified by heat and painted, sprayed, or otherwise applied over the interior surface of the chamber, generally to a thickness of 0.001 inch to 0.25 inch. Upon standing, the thermally-activatable release agent solidifies. Solidification may be accelerated by cooling. The usual internal mold, covered with conventional mold release agent, is then inserted into the chamber and the fluid elastomer is inserted, usually by pouring or injection, into the space between the inner surface of the chamber (now lined with the thermally-activatable release agent) and the mold in the same manner as conventionally practiced by the art. After a further period, representatively 24 hours, the mold is removed, leaving the elastomeric lining over the interior of the chamber. The lining continues to cure upon standing. The physical strength of the bond between the elastomeric lining, especially when a polyurethane lining is employed, and the chamber is in general as great or greater when employing the interposed layer of thermally-activatable release agent, e.g., the hot-melt adhesive, according to the invention as it was according to prior art procedure which bonded the elastomeric lining directly to the inner surface of the chamber or tub. For removal of the thus-produced elastomeric lining, the chamber may be brought to a temperature below about 250° F., usually at or below 100° C., and preferably below about 200° F., by the general application of heat, e.g., by submerging in boiling water, placing in a hot air oven, by means of resistance wrapping, or by any other suitable means. After the temperature of the thermally-activatable release agent reaches that point at which it has become softened and preferably fluid or liquid, by virtue of its loss of adhesive characteristics and viscosity at or about its softening or glass transition temperature, a hoist or crane is attached to lifting means, e.g., pull-points on, in, or abutting the elastomeric lining, whereafter the lining is pulled out of the interior of the chamber without great effort. To aid in removal of the lining after the chamber has been heated to fluidize or soften the thermally-activatable release agent, the said lifting means to assist with lifting the lining from within the chamber, preferably as an integral or unitary piece, may be employed. Such means may take the form of straps, wires, cables, or nets or other similar pull or attach points, which may be formed or embedded in or around the lining when it is cast, so that all that is necessary for removal of the lining is to attach a hoist or crane to the attach points and lift the elastomeric lining out of the chamber interior. Such procedure greatly facilitates removal of the lining once the thermally-activatable release agent, together with its abutting chamber wall and elastomeric lining, has been sufficiently heated. The temperature to which the thermally-activatable release agent should be heated is of course selected so that substantial deterioration of the elastomeric lining does not occur even when maintained at the elevated temperature for an extended period of time.

For patching a defective or worn lining in the field, the defective or worn area is defined, cut with a sharp knife, and local heat applied to the area to be patched, for example, with a hot-air gun. The defective or worn piece of elastomeric lining is then removed. A new piece of elastomeric lining, e.g., polyurethane elastomer, is then fitted into the cut-out area by cutting it from a sheet of the correct thickness and placing it in the exact position from which the original or old piece of elastomeric lining was removed. This may be effected while the thermally-activatable release agent, e.g., the hot-melt adhesive, in that particular area is still in fluid or liquid state due to local application of heat by means of the heat gun or the like. The new material bonds with acceptable strength upon cooling. Alternatively, the thermally-activatable release agent may be allowed to cool and solidify, whereafter new elastomer may be poured or cast into the area from which the old piece was removed, in which case the newly-cast elastomer will bond both to the release agent and to the abutting edges of the original elastomeric lining to give a smooth patch which in some cases is almost imperceptible. To provide for a patch of maximum strength, the abutting edges of the original lining are preferably first treated with an adhesive primer or other suitable adhesive.

In order to depict the present invention in its various aspects, the following examples are provided. These examples are by way of illustration only and are not to be construed as limiting the scope of the present invention.

EXAMPLES

Example 1

A. Test Results

A series of tests was carried out on chambers lined with various thermally-activatable release agents, namely, 3M JET-MELT hot-melt adhesives 3783, 3765, and 3735, as well as Ornsteen 4046 and 8096. The hot-melt adhesive was heated until fluid and was then painted onto the interior surface of the chamber with a brush. The layer of adhesive was then allowed to stand and cool. After the thermally-activatable release agent had solidified, a CONATHANE TU-79(TM) brand of polyurethane lining was prepared and applied to the solidified layer of release agent by mixing components A and B and pouring the resultant mixture directly onto the layer of release agent thereby to form the polyurethane lining in place. The thickness of the polyurethane elastomeric lining was approximately one (1) inch.

Tests were then performed in order to determine the physical strength of the bond between the elastomeric lining, i.e., the polyurethane lining, and the interior of the steel chamber. The tests were made in comparison with the product prepared according to the prior art, wherein the polyurethane lining was cast directly into contact with the primed interior surface of the steel chamber, by pulling upon both linings with a hoist. The bond strength of the elastomeric lining produced according to the present invention was in general equal to or better than the bond strength of the lining produced in accord with the prior art procedure.

B. Installation

The finishing chamber of a small three-compartment VIBRATRON (TM) (Roto-Finish Company, Inc.) finishing machine was then lined according to the method of the invention, as outlined in the foregoing, employing 3M hot-melt adhesive JET-MELT 3783, a latex emulsion blend of ethylene-vinylacetate copolymer and tackifier resin having a softening temperature of 145° F. and a liquid temperature (ball and ring softening point, ASTM E-28-67) of 190° F. Two flexible wires were cast in the lining of one of the compartments to constitute lifting means to aid in removal of the lining from the finishing chamber interior at a subsequent time.

C. Removal

The VIBRATRON (TM) finishing machine was operated for approximately 159 hours employing abrasive chips in one compartment and employing steel burnishing balls in the other compartment, in each case together with conventional chemical finishing compound. The third compartment was not lined. The operation was normal in every respect and the machine appeared to function as well as usual finishing machines employing finishing chambers lined according to the prior art. The test Vibratron machine was then taken out of service and the entire assembly heated up to approximately 150°–200° F., a temperature at which the thermally-activatable release agent was activated and in fluid condition, but a temperature at which the polyurethane lining did not undergo any substantial deterioration. The heating of the assembly is effected by means of a forced-air oven and, alternatively, by immersion in boiling water. Upon immersion in boiling water, substantial deterioration of the polyurethane elastomeric lining does not occur upon standing for a period of up to twenty-four hours.

While the entire assembly was at the elevated temperature between about 150° and 200° F., the embedded wires were hooked to a small overhead crane. Power was then applied to the crane and the elastomeric lining was removed in a single unitary piece with no difficulty. The test was accordingly considered a complete success.

D. Replacement

Replacement of the elastomeric lining is effected in the same manner as set forth for its original installation under Paragraph B. hereinbefore.

E. Repair

Patching of the lining is effected by defining the defective or worn area, excising the same with a sharp knife, applying local heat to the exterior of the metal finishing chamber, using a hot-air gun or other means of supplying the necessary thermal energy,to thermally activate the release agent, removing the defective or worn area of the lining, and replacing the same by an exact replicate piece of lining of identical thickness and dimensions while the hot-melt adhesive remains liquid due to continued application of the heat gun. An excellent bond of the new polyurethane elastomeric lining is obtained. The remaining cracks defined by the cuts, to the extent still visible, are if desired filled with cast polyurethane, that is, CONATHANE TU-79 (TM), in the same manner in which the lining was originally cast.

Example 2

This Example is conducted in the same manner as given in the foregoing Example 1, Paragraphs B through E, but substituting 3M JET-MELT hot-melt adhesive 3765, having a softening point of 172° F., for hot-melt adhesive 3783 as the thermally-activatable release agent. The 3M JET-MELT hot-melt adhesive 3765 is a blend of ethylene/vinylacetate copolymer, hydrocarbon resin, thermoplastic resin, and wood rosin, to the extent of 99 percent, together with 1 percent antioxidant. The procedure followed is exactly the same and the results are the same and equally satisfactory.

Example 3

The procedure of Example 2 is repeated, but employing Dexter Hysol hot-melt adhesive 4046, having a softening point of 193° F., and being a physical mixture of rubber, ethylene-vinylacetate, resin, and petroleum hydrocarbon. The results are the same and equally satisfactory.

Example 4

The procedure of Example 2 is repeated, but employing Dexter Hysol hot-melt adhesive 8096, having a softening point of 206° F., as the thermally-activatable release agent. This hot-melt adhesive is a physical mixture of rubber and ethylene-vinylacetate resin. The results are the same and equally satisfactory.

Example 5

The procedure of Example 2 is repeated, but employing Ornsteen hot-melt adhesive 4046, having a softening point of 193° F., as the thermally-activatable release agent. The results are the same and entirely satisfactory.

Example 6

The procedure of Example 2 is repeated, but employing Ornsteen hot-melt adhesive 8096, having a softening point of 206° F., as the thermally-activatable release agent. The results are the same and entirely satisfactory.

Other brands and types of polyurethane elastomer may be employed with equal facility, as well as other types of elastomeric lining and a wide variety of thermally-activatable release agents, e.g., the hot-melt adhesives or the like previously mentioned. In each case the elastomeric lining has a normal appearance and hardness and is bonded to the interior surface of the chamber by a bond of acceptable strength upon curing of the cast or poured elastomer in the case of an original lining or a poured or cast patch, and by the reactivated and then resolidified thermally-activatable release agent in the case of a pieced patch. Removal of the lining as an essentially integral entity or unit is affected in the same manner as given in the foregoing example, namely, by heating the thermally-activatable release agent to a thermally-activatable temperature at which it is thermally activated for a period of time sufficient to render the thermally-activatable release agent softened, fluid, or liquid to a sufficient extent that the elastomeric lining may be pulled away from the chamber in an essentially unitary or integral piece, the temperature and the period of temperature elevation in all cases being such as not to cause material deterioration of the elastomeric lining itself.

FINISHING MACHINES

According to the present invention, representative types of finishing machines which may be provided with chambers lined according to the invention are those used for grinding, deburring, descaling, edge-breaking, polishing, bright-honing, burnishing, and other surface finishing of parts or workpieces, which may and generally do comprise wood, metal, ceramic, glass, or the like. U.S. Patents representatively showing a vibratory finishing machine embodying a finishing chamber having an interior lining are U.S. Pat. Nos. 3,161,993; 4,012,869; and 4,022,012, respective reference being made to column 5, column 7, and column 9 thereof. For still other types of finishing apparatus wherein finishing chambers lined with an elastomeric material may be advantageously employed, reference is made to U.S. Pat. Nos. 3,981,693, 3,990,188, 4,162,900, 4,172,339, and 4,177,608. As previously stated, the finishing chamber may be employed in a vibratory or gyratory machine, a rotational finishing machine, a combination of vibratory or gyratory and rotational machine, a tumbling barrel, or any other conventional type, whether the finishing chamber itself is tub-type, curvilinear, annular, annular with a step in its bottom, and so on, or any like chamber. The chamber lining of the invention is advantageous for any finishing or other chamber wherein it is desired to attain one or more of the advantages previously mentioned as attainable according to the present invention. As used herein, "gyratory" is a particular species of "vibratory" as applied to a finishing process or machine.

FINISHING MEDIA

By the term "loose finishing material" or "finishing medium", or "media", as used here, is intended to include loose, comminuted, granular, or particulate, and in any event, solid finishing materials of the type which are presently employed in the trade and any others of a similar nature. Although liquid finishing materials or "compound" may also be used in conjunction with the solid finishing materials, these are considered to be ancillary. Moreover, the terms first set forth in this paragraph are used herein generally to designate such solid materials which are used to impart all types of finishes including those finishes acquired with abrading materials as well as polishing materials and the like, "polishing", "burnishing", etc., being terms considered in their usual sense as species of "finishing". Such suitable finishing media include porcelain, ceramic, aluminum, steel, zinc, stainless steel, granite chips, and the like, all as well-known in the art, and in various sizes and configurations, also as well-known in the art. Such configurations are representatively cones, bars, cylinders, squares, stars, and the like.

It is thereby seen from the foregoing that all of the objects of the present invention have been accomplished and in addition that an extremely simple and economical procedure for lining, removal, repair and replacement of lining from a chamber, adapted to be the finishing chamber of a finishing machine or the like, has been provided. In addition, a further advantage of the present lining, lined tub and procedure is that welding can be effected on the chamber after lining the chamber without damage to the lining whereas, in the past, this has not been possible because heat applied to the chamber exterior would break the bond between the chamber and the interior elastomeric lining, especially when a polyurethane lining was involved.

Although preferred embodiments of the invention have been illustrated in the accompanying drawings and described in the foregoing description, it is to be understood that the invention is not limited to the embodiments disclosed or to the exact details of operation or exact compounds, compositions, methods, or procedures shown and described, since the invention is capable of numerous modifications, rearrangements, and substitutions of parts and elements and other equivalents, both chemical and mechanical, without departing from the spirit or scope of the invention, as will readily be apparent to one skilled in the art.

We claim:

1. A chamber having an interior elastomeric lining suitable for use as the finishing chamber of a finishing machine or the like, comprising the said chamber, an interior elastomeric lining therefor, and interposed between the inner surface of said chamber and said lining a layer of thermally-activatable release agent in solid form, said thermally-activatable release agent being thermally activatable at a temperature below that temperature at which substantial deterioration of the said elastomeric lining occurs, said chamber comprising also lifting means in said interior lining or in said release agent layer for attachment of pulling means to assist with removal of said interior elastomeric lining from said chamber.

2. The chamber of claim 1, wherein the elastomeric lining is formed from a material selected from the group including natural and synthetic elastomers.

3. The chamber of claim 1, wherein said elastomeric lining comprises a polyurethane.

4. The chamber of claim 1, wherein the lining is a formed-in-place polyurethane lining.

5. The chamber of claim 1, wherein said thermally-activatable release agent is thermally activatable at a temperature below about 250° F.

6. The chamber of claim 1, wherein said thermally-activatable release agent is thermally activatable at a temperature below about 200° F.

7. The chamber of claim 1, wherein said thermally-activatable release agent is thermally activatable at a temperature at or below about 100° C.

8. The chamber of claim 1, wherein said thermally-activatable release agent is a hot-melt adhesive.

9. A finishing machine embodying a finishing chamber according to any of claims 1 through 8.

* * * * *

UNITED STATES PATENT AND TRADEMARK OFFICE

CERTIFICATE OF CORRECTION

PATENT NO. : 4,480,411

DATED : November 6, 1984

INVENTOR(S) : Gunther W. Balz and Henry L. Upjohn

It is certified that error appears in the above-identified patent and that said Letters Patent is hereby corrected as shown below:

Col. 5, line 62; "liming" should read -- lining --
Amendment dated June 1, 1984, page 1.

Signed and Sealed this

*Twentieth* Day of *August 1985*

[SEAL]

*Attest:*

DONALD J. QUIGG

*Attesting Officer*

*Acting Commissioner of Patents and Trademarks*